US006640398B2

(12) United States Patent
Hoffman

(10) Patent No.: US 6,640,398 B2
(45) Date of Patent: Nov. 4, 2003

(54) MAGNETIC CLASP FOR JEWELRY

(76) Inventor: Leslie C. Hoffman, 10445 Wilshire Blvd., Penthouse, Westwood, CA (US) 90024

( * ) Notice: Subject to any disclaimer, the term of this patent is extended or adjusted under 35 U.S.C. 154(b) by 0 days.

(21) Appl. No.: 10/104,639

(22) Filed: Mar. 22, 2002

(65) Prior Publication Data

US 2002/0116794 A1 Aug. 29, 2002

Related U.S. Application Data

(63) Continuation-in-part of application No. 09/487,424, filed on Jan. 20, 2000, now Pat. No. 6,363,584.

(51) Int. Cl.[7] ..... A44B 21/00; A44C 5/00

(52) U.S. Cl. ..... 24/303; 24/66.1; 24/68 J; 24/71 J; 70/459; 292/251.5

(58) Field of Search ..... 24/303, 66.1, 71 J, 24/68 J; 70/459; 292/251.5; 335/285

(56) References Cited

U.S. PATENT DOCUMENTS

| | | | | |
|---|---|---|---|---|
| 2,197,882 A | | 4/1940 | Simpson | |
| 2,597,887 A | | 5/1952 | Meeker | |
| 2,615,227 A | | 10/1952 | Hornik | |
| 2,659,169 A | | 11/1953 | Brennan | |
| 2,752,764 A | | 7/1956 | Lederer | |
| 2,860,395 A | | 11/1958 | Anderson | |
| 3,034,320 A | | 5/1962 | Feibelman | |
| 3,041,697 A | | 7/1962 | Budreck | |
| 3,071,939 A | | 1/1963 | Feibelman | |
| 3,129,477 A | | 4/1964 | Mizuno | |
| 3,509,734 A | | 5/1970 | Lederer | |
| 3,639,949 A | | 2/1972 | Beck | |
| 3,670,525 A | | 6/1972 | Mulligan | |
| 3,813,732 A | | 6/1974 | Seavey | |
| 4,052,864 A | | 10/1977 | Hofsaess | |
| 4,231,137 A | | 11/1980 | Fujimoto | |
| D263,765 S | | 4/1982 | Engelhardt | |
| 4,536,732 A | | 8/1985 | Schindl et al. | |
| 4,901,405 A | * | 2/1990 | Grover et al. | 24/303 |
| 4,912,944 A | | 4/1990 | Crosley et al. | |
| 5,008,984 A | * | 4/1991 | Levy | 24/303 |
| 5,036,681 A | | 8/1991 | Schaerer | |
| 5,050,276 A | | 9/1991 | Pemberton | |
| 5,099,659 A | | 3/1992 | Carranza et al. | |
| 5,195,335 A | | 3/1993 | Hart | |
| 5,197,168 A | * | 3/1993 | Levy | 24/303 |
| 5,317,789 A | * | 6/1994 | Levy | 24/303 |
| 5,349,725 A | * | 9/1994 | Levy | 24/303 |
| 5,367,891 A | | 11/1994 | Furuyama | |
| 5,535,603 A | | 7/1996 | Hayakawa | |
| 5,664,298 A | * | 9/1997 | Nessar-Ivanovic | 24/303 |
| 5,806,346 A | | 9/1998 | Schlinger et al. | |
| 5,845,373 A | | 12/1998 | Langer | |
| 6,292,985 B1 | * | 9/2001 | Grunberger | 24/303 |

FOREIGN PATENT DOCUMENTS

| | | |
|---|---|---|
| CA | 656059 | 1/1963 |
| JP | 405317105 A | 12/1993 |

* cited by examiner

*Primary Examiner*—Victor Sakran
(74) *Attorney, Agent, or Firm*—Fulbright & Jaworski, LLP

(57) ABSTRACT

Magnetic clasps for securing the opposed ends of chains and other jewelry. Each clasp includes an arrangement for securing separable bodies by means of magnets that have been poled to present opposed surfaces of opposite magnetic polarities. In a first embodiment, disk-like magnets are received in channels of mating elongated body members of like configuration. End flanges of the elongated body members, in addition to the disk-like magnets, provide axial resistance to separation while the resultant magnetic force prevents separation in the transverse direction. In a second embodiment, disk-like magnets of divided polarities are seated at ends of mating bodies. A pin-and-slot locking mechanism is formed in the two bodies and the magnets are oriented relative thereto so that resultant repulsive magnetic forces force the two magnets into mating alignment when in the longitudinal slot for maximum magnetic holding force. In a third embodiment, magnetic disks are held side-by-side by holders within a split hemispherical housing.

6 Claims, 3 Drawing Sheets

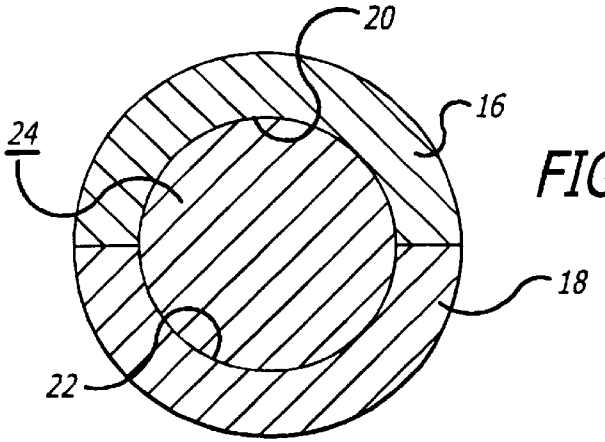
FIG. 3
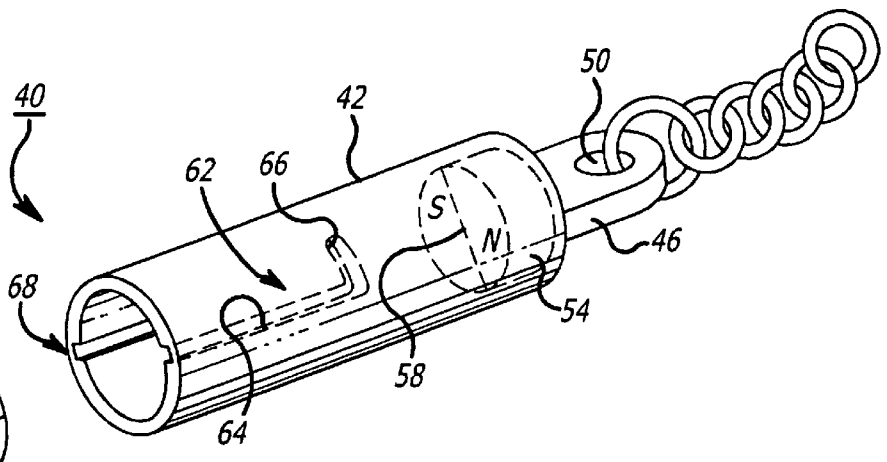
FIG. 4
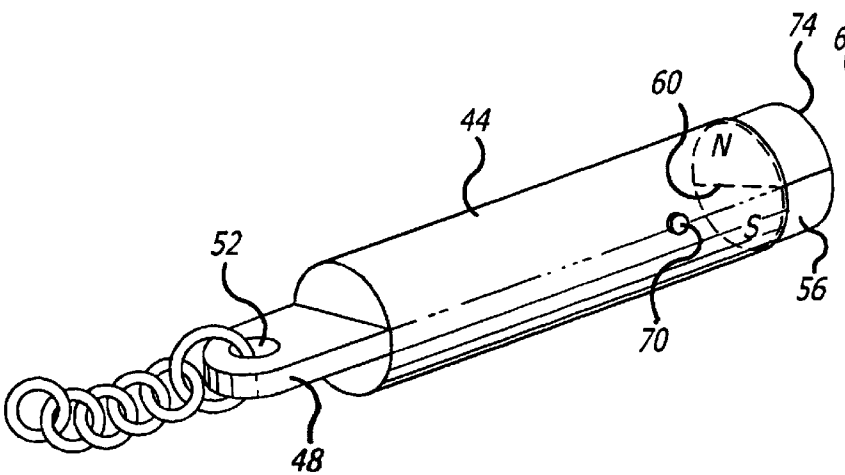

MAGNETIC CLASP FOR JEWELRY

REFERENCE TO RELATED APPLICATION

The present application is a continuation-in-part of U.S. patent application Ser. No. 09/487,424 of co-inventors George Gero, Leslie C. Hoffman and Raymond D. Lathrop covering "Cuff Link With Changeable Element" filed Jan. 20, 2000 now U.S. Pat. No. 6,363,584.

BACKGROUND

1. Field of the Invention

The present invention relates to articles that facilitate the use of jewelry. More particularly, this invention pertains to jewelry clasps in which clasp members are secured, at least in part, by magnetic force.

2. Description of the Prior Art

The design of articles of jewelry is complicated by the need to combine function with appearance. Often a tradeoff is involved and such tradeoff is made particularly difficult when a device, such as a clasp is responsible for the security of often-extremely valuable articles such as pearls, pendants, necklaces and the like.

Clasps come in numerous designs and employ many functional means for securing to the wearer. While providing a secure locking mechanism, the design of a truly effective clasp must accommodate ready and mostly blind manipulation by the wearer. The size and shape of the clasp must not detract from less-functional elements of the jewelry.

As a consequence of the above criteria, it is recognized that the design of an easy-to-manipulate and secure clasp that does not detract from, and, in fact may add to the appearance and value of a necklace or the like poses a significant challenge to the jewelry designer/manufacturer.

SUMMARY OF THE INVENTION

The preceding and other shortcomings of the prior art are addressed and overcome by the present invention that provides, in a first aspect, a clasp for selectively joining a first element to a second element. Such clasp includes a first body member having a flange adapted to receive the first element. A second body member has a flange adapted to receive the second element.

Each of the body members includes at least one magnet. The body members are arranged so that a common magnetic field selectively secures the members to one another.

In second aspect, the invention provides a clasp for selectively joining a first element to a second element. Such clasp includes an elongated first generally-cylindrical body of a first diameter having opposed open and closed ends. A flange is fixed to the exterior surface of the closed end of the elongated first body.

A first disk-like magnet is arranged transverse to the axis of symmetry of and within the elongated first generally-cylindrical body. Such first disk-like magnet comprises semicircular disk regions divided by a first diameter with each semicircular disk region having opposed major surfaces of opposite magnetic polarity. Semicircular disk regions of the first disk-like magnet have major surface regions of opposite polarities on opposite sides of the first diameter.

An elongated second generally cylindrical body of a second diameter has a first closed end. A flange has an internal aperture fixed to the closed while the opposed end is closed by a second disk-like magnet arranged transverse to its axis of symmetry. The second magnet comprises two semicircular disk regions divided by a second diameter, each with opposed major surfaces of opposite magnetic polarity. The major disk regions of the second magnet are of opposite magnetic polarities at opposed sides of the second diameter. The second diameter is less than the first diameter whereby the elongated second generally cylindrical body may be received within the elongated first generally-cylindrical body.

In a third aspect, the invention provides a clasp for selectively joining a first element to a second element that includes a first generally-hemispherical housing element and a second generally-hemispherical housing element. A first magnet and a second magnet are provided. A first holder is adapted to receive the first magnet within the first generally-hemispherical housing and a second holder is adapted to receive the second magnet within the second generally-hemispherical housing.

Each of the first and second magnets comprises opposed surfaces of opposite magnetic polarity and the first and second holders are arranged to position the first magnet relative to said second magnet when the first and second generally-hemispherical housing elements are oriented to form a hemisphere so that surfaces of opposite magnetic polarity of the first and second magnets are adjacent one another.

The preceding and other features and advantages of the present invention will become further apparent from the detailed description that follows. Such description is accompanied by a set of drawing figures. Numerals of the drawing figures, corresponding to those of the written description, point to the features of the invention with like features referring to like features throughout both the written description and the drawings.

BRIEF DESCRIPTION OF THE DRAWINGS

FIG. 3 is a cross-sectional view of the closed clasp of the invention taken at line 3—3 of FIG. 1;

FIG. 4 is an exploded perspective view of a magnetic clasp in accordance with an alternative embodiment of the invention.

DETAILED DESCRIPTION OF THE PREFERRED EMBODIMENT

Figure 1:
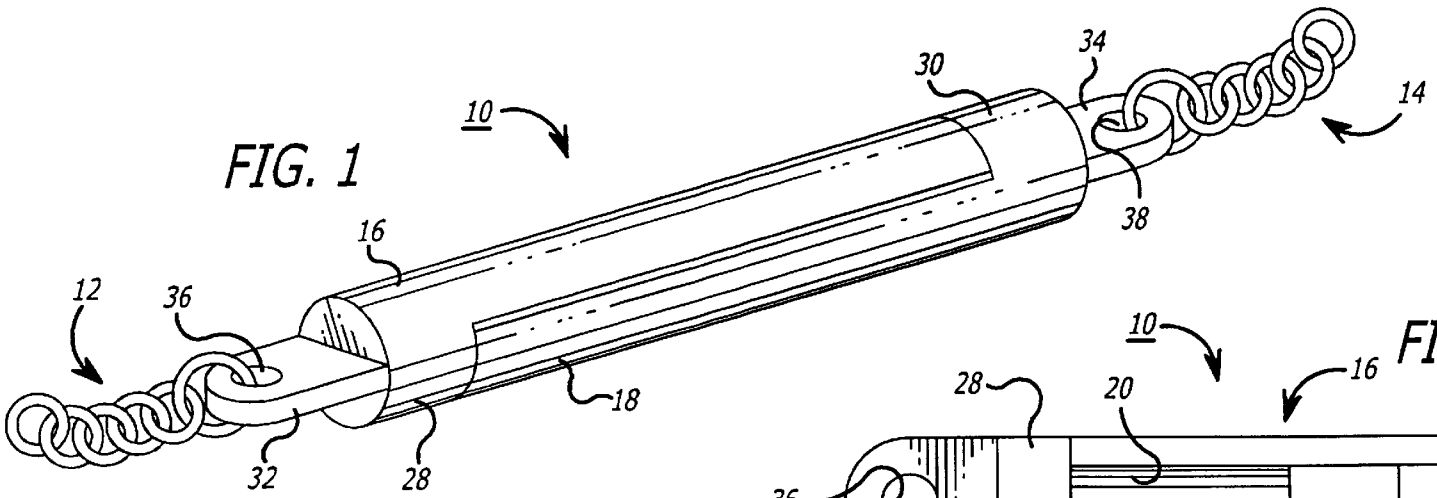
FIG. 1 is a perspective view of a clasp in accordance with a first embodiment of the invention.

FIG. 1 is a perspective view of a clasp 10 in accordance with the invention. The clasp 10 may provide a means for selectively connecting the opposed ends 12, 14 of a jewelry chain. The clasp 10 provides a secure and easily manipulated means that resists axial separation of mating body members 16, 18 with a design that offers mechanical resistance to axial force as the members 16, 18 are held together by magnetic force. Such magnetic force, in turn, permits simpler attachment and detachment of the members 16, 18 than prior art clasps that rely upon mechanical affixation arrangements. It will be further seen that the design of the clasp 10 assures that the separable body members 16, 18 cannot be accidentally joined in such a way that the advantages of the invention are not realized.

Figure 2B:
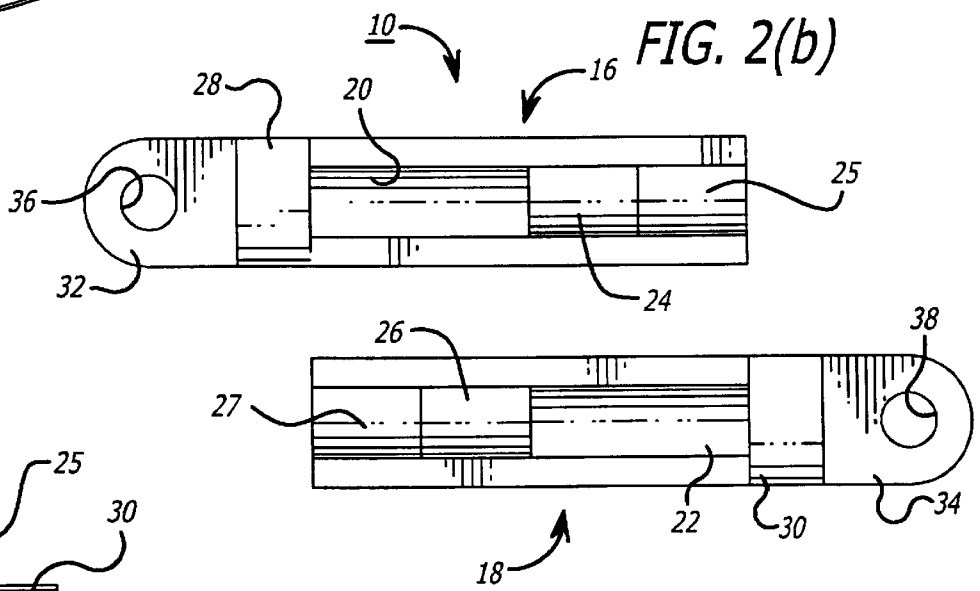
FIGS. 2(*a*) and 2(*b*) are side elevation and top planar views of the component elements of the clasp of FIG. 1, such elements being juxtaposed to facilitate one's appreciation of the manner of assembly and latching of the device.
Figure 2A:
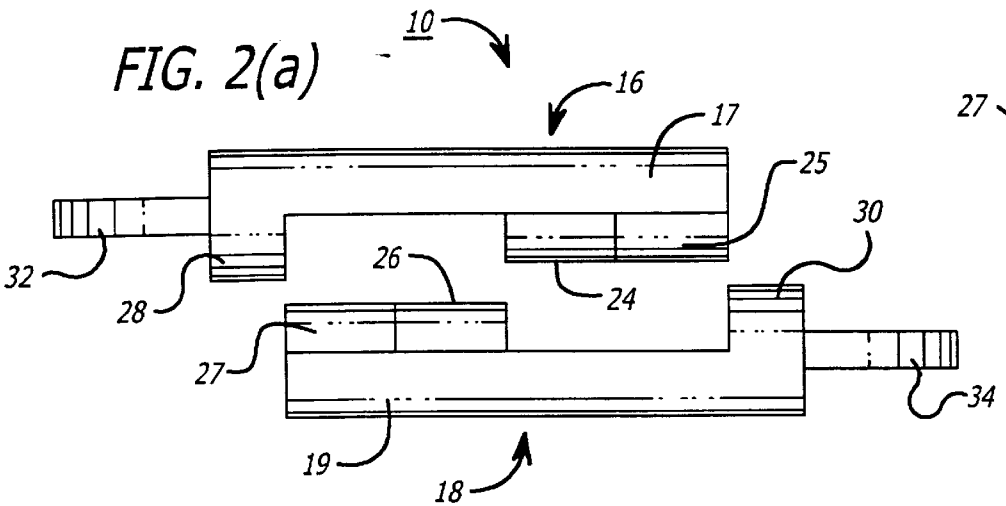

FIGS. 2(*a*) and 2(*b*) are side elevation and top planar views of the component elements of the clasp 10, such elements being juxtaposed to facilitate an appreciation of the manner of latching of the clasp 10. Each of the mating body members 16, 18 includes a frame 17, 19, respectively, of nonmagnetic material having an interior slot 20, 22 respectively for receiving cylindrical magnets 24 and 26. The magnets 24, 26 are fixed therein adjacent distal end members 25 and 27 of the frames 17 and 19 respectively. Each of the distal end members 25 and 27 is integral with the associated frame and, of course, of identical nonmagnetic material. As can be seen in FIG. 3, a cross-sectional view of the clasp taken at line 3—3 of FIG. 1, the interior slots 20 and 22 in combination form a cylindrical cavity for receiving the magnets 24, 26 when the clasp 10 is closed.

The magnets are each poled to have opposed circular surfaces of opposite magnetic polarities. The are, in turn, aligned within the slots 20 and 22 so that facing surfaces of the two magnets 24 and 26 are of opposite magnetic polarity. In this way continuous paths of magnetic flux through the (magnetic or nonmagnetic) metallic bodies of the mating members 16 and 18 and the magnets 24, 26 are achieved and a strong magnetic bond formed. This bond is readily broken when desired by simply twisting the two members 16 and 18 from one another with one's fingertips. Unlike prior art clasps, difficult manipulations of small mechanisms is not required. In addition, by providing non-magnetic distal end members 25, 27 to thereby "shield" the ends of the frames 17 and 19 so that magnetic flux is not emergent therefrom, unintended end-to-end mating of the body members 16 and 18 cannot occur. This is particularly significant as such an end-to-end arrangement, a potential hazard of often-blind assembly, would not enjoy the benefit of mechanical resistance to axial separation forces (discussed below).

Each of the slots 20, 22 is closed by a disk-like proximal end member formed integral with the body members 16 and 18 respectively. The proximal end members 28, 30 are arranged transverse to the longitudinal axes of the slots 20, 22 and provide a location for fixing flanges 32, 34 having apertures 36 and 38 respectively that provide means for joining the opposed ends 12, 14 of a chain to the clasp 10. The side-by-side relationship between the cylindrical magnets 24, 26 within the cylindrical cavity, combined with the fact that each of the magnets 24 and 26 is positioned remote from the associated proximal end member 28 or 30 (to which outwardly-axial force may be applied from the ends 12, 14 of the chain) creates a mechanism for mechanically preventing axial forces (due, for example to the weight of a pendant or the force of a tug on an attached chain) from dislodging the magnetically-bonded mating body members 16, 18 from one another.

FIG. 4 is an exploded perspective view of a magnetic clasp 40 in accordance with an alternative embodiment of the invention. In this embodiment, magnetic forces are employed to facilitate the interlocking of elongated first and second generally cylindrical bodies 42 and 44 respectively. End members 46 and 48 are attached to the open-ended bodies 42, 44 and include apertures 50, 52 for receiving the ends of a chain (not shown) in use. Disk-like magnets 54, 56 are fixed to the first and second bodies respectively. Each of the magnets is poled so that one half of a major surface (divided by a diameter) is of one magnetic polarity and the other half is of opposite polarity. The opposed surface of each magnet 54, 56 is poled to be of reversed polarities so that, in effect, each of the two magnets 54, 56 is comprised of two side-by-side semicircular disks of reversed polarizations.

The magnet 54 that is fixed to the end of the body 42 is divided into regions of opposite magnetic polarities along a diameter 58 whereas the magnet 56 that caps the open end of the second body is similarly divided at a diameter 60. The inner diameter of the elongated first generally-cylindrical body 42 is somewhat larger than the outer diameter of the elongated second generally-cylindrical body 44. This permits the insertion of the elongated second generally-cylindrical body 44 into the elongated first generally-cylindrical body for close the clasp 40.

A keying arrangement further secures the relationship between the elongated first and second generally-cylindrical bodies 42 and 44. This relationship is accomplished by the interaction of L-shaped slots formed interior to the first elongated generally-cylindrical body 42 with radially-directed pins of the elongated second generally-cylindrical body 44. A first L-shaped slot 62 includes a longitudinal slot portion 64 that terminates at and intersects a radial slot portion 66. A like L-shaped slot 68 is formed 180 degrees from the slot 62.

Radially-directed pins 70 (only one visible in the figure) emerge from the second body 44 to interact with the slots 62 and 68 and thereby lock the bodies 42 and 44 to one another. The distance "d" that separates the radial slot portion 64 from the interior surface 72 of the magnet 54 is equal to the distance between the pin 70 and the surface 74 of the magnet 56 that faces the elongated first generally-cylindrical body 42. This assures that the surfaces 72 and 74 are closely adjacent one another when the elongated generally-cylindrical bodies 42 and 44 are locked to one another. Additionally, the two magnets 54 and 56 are so arranged with respect to one another that the diameters 58 and 60 that delineate the borders between areas of unlike magnetic polarizations of the two magnets are angularly displaced by 90 degrees from one another when the pin 70 is in the longitudinal slot portion 64. This occurs as the elongated first and second generally-cylindrical bodies 42 and 44 are either in the process of being joined into locked engagement or being separated from one another.

By angularly offsetting the regions of like magnetic polarization from one another while the pin 70 is in the longitudinal slot 64 and in the process of being advanced into engagement, one can be assured that there will exist both attractive and repulsive forces (or increasing magnitudes) between the magnets 54 and 56 as the elongated first and second generally-cylindrical bodies 42 and 44 are advanced into engagement. The magnets 54 and 56 are further arranged so that, as the pin 70 is advanced through and to the terminus of the radial slot portion 66, the diameters 58 and 60 come into alignment with regions of the adjacent magnet surfaces 72 and 74 of opposite polarities lying atop one another. This assures that the mechanical interlock provided by the interaction of slot and pin is enhanced by the magnetic attraction between the magnets 54 and 56.

Figure 5A:
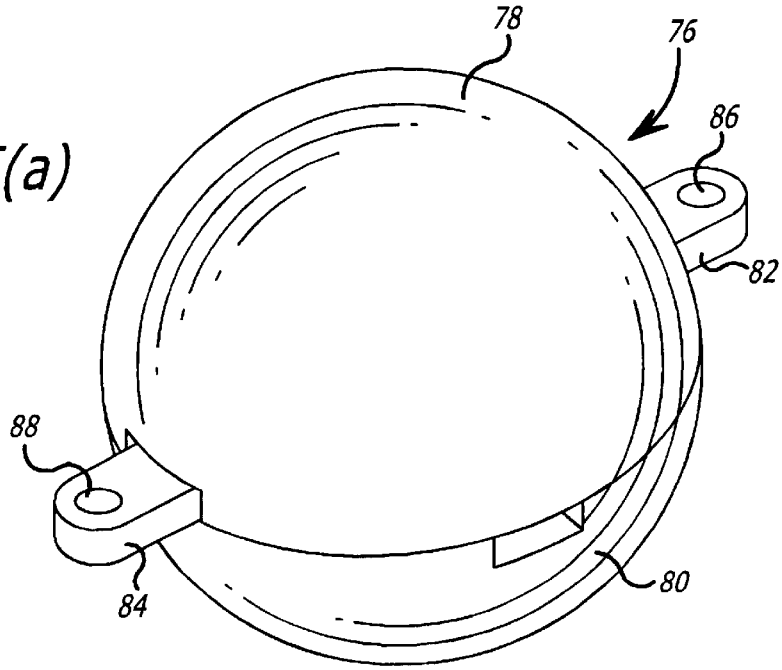
FIGS. 5(*a*) and 5(*b*) are assembled and exploded perspective views, respectively, of a magnetic clasp in accordance with a second alternative embodiment of the invention.
Figure 5B:
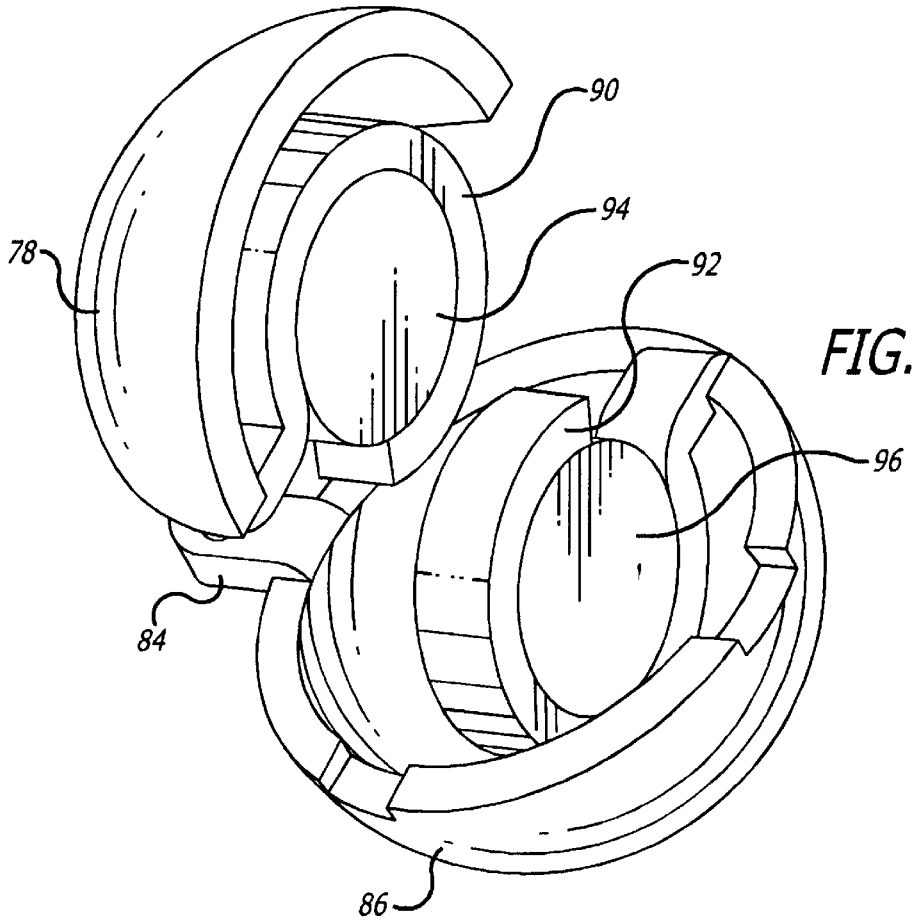

FIGS. 5(*a*) and 5(*b*) are assembled and exploded perspective views, respectively, of a magnetic clasp 76 in accordance with a second alternative embodiment of the invention. The clasp 76, unlike the prior elongated embodiments, offers a spherical appearance. As in the case of the prior embodiments, it employs magnetic force to secure engagement between its mating halves.

Viewing FIGS. 5(*a*) and 5(*b*) in combination, the clasp 76 includes mating hemispherical housings 78, 80. Flanges 82 and 84 having apertures 86 and 88 extend from the edges of the hemispherical housings 78, 80 and provide a means for attachment of the ends of a chain. Hook-like holders 90, 92 extend within and are fixed to the hemispherical housings 78 and 80 respectively. The holders are crimped to and thereby secure disk-like magnets 94, 96. Each of such magnets 94 and 96 is poled so that opposed surfaces are of opposite magnetic polarities. The holders 90 and 92 are fixed to the associated hemispherical housings to be offset from and adjacent one another. In this way, the disk-like magnets 94, 96 held therein are positioned adjacent one another when the clasp 76 is closed to form a sphere. The magnets are arranged so that surfaces of opposite magnetic polarities thereof are adjacent one another when the clasp 76 is closed. This may be seen to resemble the manner in which the cylindrical magnets 24 and 26 of the clasp 10 are positioned. As in the case of such prior embodiment, the flanges 82 and 84 to which the ends of a chain are attachable, and through which an axial separation force may be applied are so located with respect to the holders 90, 92 and magnets 94, 96 that, upon encountering an axial tension force, the disk-like magnets 94 and 96 abut against one another to provide resistance to axial separation as in the case of the clasp 10. The combination of mechanical resistance to undesired axial separation with simple-to-manipulate magnetic closure and opening characterizes this embodiment as is the case of the embodiment of FIGS. 1 through 3.

Thus it is seen that the present invention provides magnetized clasps that are particularly suitable for jewelry. By utilizing the teachings of this invention one may obtain the advantages of mechanical resistance to separation coupled with the easy-to-manipulate closure and opening offered by the substitution of a magnetic for a mechanical closure arrangement.

While the present invention has been described with reference to its presently-preferred embodiment, it is not limited thereto. Rather, this invention is limited only insofar as it is defined with respect to the following set of patent claims and includes within its scope all equivalents thereof.

What is claimed is:

1. A clasp for selectively joining a first element to a second element, the clasp comprising:

a) a first generally elongated body member having opposed first and second ends and comprising a flange located at one of the ends, the flange for receiving the first element; and b) a second generally elongated body member having opposed first and second ends and comprising a flange located at one of the ends, the flange for receiving the second element;

wherein each body member further comprises:

(i) a generally semi-cylindrical elongated frame of nonmagnetic material, the frame having an internal semi-cylindrical coaxial channel and comprising a disk-like end member and a cylindrical end member which are located at opposite ends of the channel, and (ii) at least one magnet located within the channel for selectively securing the body members to each other through a common magnetic field.

2. A clasp as defined in claim 1 wherein said flange of a body member is connected to said disk-like end member of that body member.

3. A clasp as defined in claim 2 wherein each of said magnets is generally cylindrical.

4. A clasp for selectively joining a first element to a second element, the clasp comprising, in combination:

a) an elongated first generally-cylindrical body of a first diameter, the elongated body having opposed open and closed ends;

b) a flange having an internal aperture connected to the exterior surface of said closed end of said elongated first body;

c) a first disk-like magnet arranged transverse to the axis of symmetry of and within said elongated first generally-cylindrical body, said first disk-like magnet comprising semicircular disk regions which are divided by a first diameter, and which comprise opposed major surfaces of opposite magnetic polarity on opposite sides of the first diameter;

d) an elongated second generally-cylindrical body of a second diameter, the elongated second body comprising at least one radially directed pin which extends from the exterior surface thereof and having a first closed end and an opposed end, the opposed end being closed by a second disk-like magnet arranged transverse to the axis of symmetry of the elongated second body, the second magnet comprising two semicircular disk regions which are divided by a second diameter and which comprise opposed major surfaces of opposite magnetic polarity on opposite sides of the second diameter;

e) a flange connected to the first closed end of the elongated second body, the flange having an internal aperture;

wherein the second diameter is less than the first diameter such that the elongated second generally-cylindrical body can be received within the elongated first generally-cylindrical body, and wherein the elongated first generally-cylindrical body further comprises at least one L-shaped slot comprising a longitudinally-directed slot portion, for receiving the pin of the elongated second generally-cylindrical body, and an intersecting radially-directed slot portion.

5. A clasp as defined in claim 4 wherein said first diameter is aligned with said second diameter when said pin is received at the free end of said radial slot portion.

6. A clasp as defined in claim 4 comprising:

a) two L-shaped slots;

b) two radially-directed pins fixed to the exterior of said elongated second generally-cylindrical body; and c) said L-shaped slots and said pins being arranged so that said pins may simultaneously engage and be seated within the L-shaped slots.

* * * * *